United States Patent [19]

Forrest

[11] 4,047,461

[45] Sept. 13, 1977

[54] PIANO KEY BUTTON ALIGNMENT TOOL

[76] Inventor: Lew Forrest, 21414 DeLaOsa St., Woodland Hills, Calif. 91364

[21] Appl. No.: 697,379

[22] Filed: June 18, 1976

[51] Int. Cl.[2] ..... G10G 7/00

[52] U.S. Cl. ..... 84/458; 84/453

[58] Field of Search ..... 84/436, 438, 439, 453, 84/458

[56] References Cited

U.S. PATENT DOCUMENTS 3,585,899 6/1971 Jaras ..... 84/458

*Primary Examiner*—Lawrence R. Franklin

*Attorney, Agent, or Firm*—Robert E. Geauque

[57] ABSTRACT

A jig to establish the precise location of a piano key button upon a piano key which takes the form in the shape of a parallelogram with the sides being pivotable with respect to each other. Upon one of the shortened sides of the parallelogram shaped jig is an abutting plate wherein the abutting surface of the abutting plate is located perpendicular to the longitudinal center axis of the shortened side to which it is attached. Upon the opposite shortened side of the parallelogram shaped jig are a pair of aligning pins and the line interconnecting the center of the pins is located perpendicular to the longitudinal center axis of this shortened side member. The pair of pins are to be conducted through a longitudinal slot formed within the key button and to be connected with an appropriate opening formed within the piano key. The plate abutting member is to be placed in flush contact with or in line with the side of the fingertip portion of the piano key with the result being a precise locating of the key button upon the piano key. The key button is then glued or otherwise fixedly secured to the piano key.

5 Claims, 6 Drawing Figures

PIANO KEY BUTTON ALIGNMENT TOOL

BACKGROUND OF THE INVENTION

The field of this invention relates to musical instruments and more particularly to a device to assist in the repairing of pianos.

Within pianos there is a plurality of side by side elongated members which are generally referred to as piano keys with there being a piano key for each different musical note on the piano. The piano key has a fingertip section which is commonly referred to as "the ivories." The inward portion of the piano key which extends within the cabinet portion of the piano terminates in a striker member adapted to strike one or more wire strings to produce a desired musical note. Intermediate the striking end of the piano key and the fingertip section of the piano (at approximately the mid point thereof) is an opening. The opening is mounted upon a pin and it is about this pin that the piano key pivots as the key is struck. There is a separate pin for each key and these pins are mounted on a longitudinal bar which is fixed within the cabinet of the piano.

Attached to the piano key in the area of this opening and connecting with the pin is a key button which normally is constructed of wood. This key button includes within the longitudinal opening a felt bushing which provides for movement of the pin during the pivoting motion. Not only does this opening provide for movement of the pin, but it guides the movement in a precise manner. It is necessary that the movement of the pin with respect to the longitudinal slot of the key button be in a plane parallel to the plane of the movement of the fingertip section of the key as it is depressed. If the movements are not parallel, the key will tend to contact the keys on either side thereof and this contact may detract from the produced tone of the key. Also, it is possible that two or more keys will then move together. Also, a key that is restrained from free movement because of non-parallel alignment of the key button slot will produce a "touch" or feeling that is unacceptable to the player.

This problem is complicated since the piano keys are not all straight longitudinal members but frequently contain various angles of deflection so that the striker portion of the key is offset from the fingertip portion of the key.

The replacement of the key buttons is required due to possible releasing of the adhesive securing the key button to the key or the fact that the felt bushing in the longitudinal slot within the key button or the slot itself has become excessively worn, or the fact that the key button may have broken from use. In any instance, the key button must be replaced.

The normal procedure for replacing a key button is to remove the key from the piano upon which the worn or misplaced key button is located. The old key button is removed and a new key button is replaced thereon. The placement can be either accomplished manually by visually observing what is believed to be the correct replacement, or a separate alignment apparatus can be employed which requires removing of at least one adjacent key for reference. The manual procedure is undesirable as the key button cannot be precisely located upon the key to the degree of accuracy that is necessary and also the other method requires the additional step of removing an adjacent key which in and of itself is not required to be removed.

SUMMARY OF THE INVENTION

The structure of this invention is believed to be summarily described in the Abstract Of The Disclosure and reference is to be had thereto.

The primary objective of this invention is to construct a device which can be used as a jig to precisely locate in each and every instance a key button upon a piano key, regardless of whether the piano key is a straight key or regardless of what offset is formed within the piano key.

The jig of this invention does not require alignment reference to be made to any key except the one on which the key button is being replaced.

The jig of this invention can be constantly reused and will last for an indefinite period of time.

The jig of this invention is constructed of few parts, is quite small in size and can be manufactured inexpensively. The small size also facilitates portability of the jig.

The jig can be operated quickly and easily by an unskilled person.

DETAILED DESCRIPTION OF THE SHOWN EMBODIMENT

Figure 1:
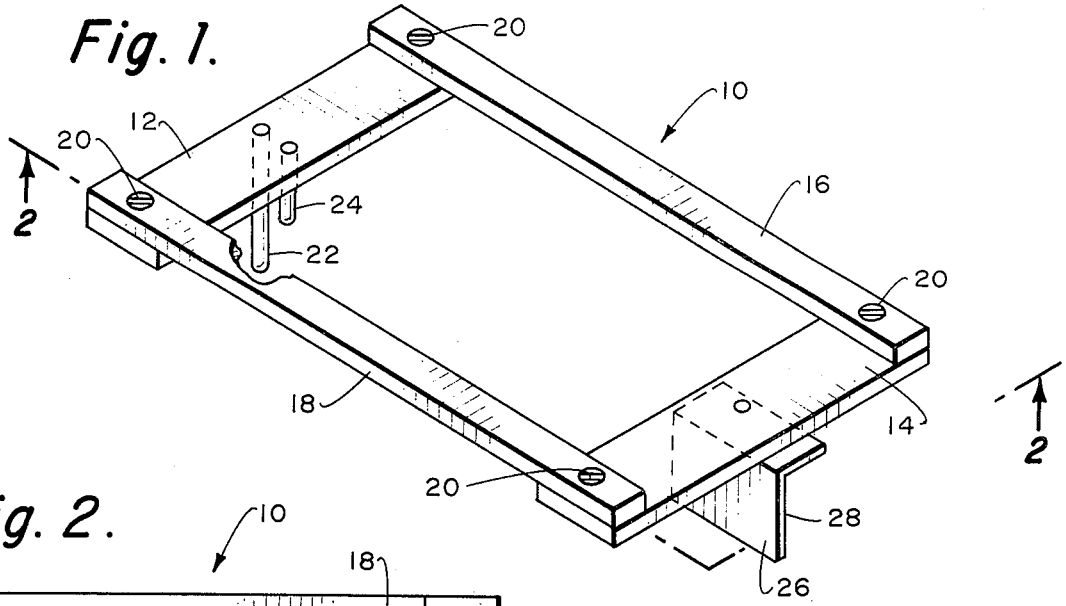
FIG. 1 is an isometric view of the jig apparatus of this invention.
Figure 2:
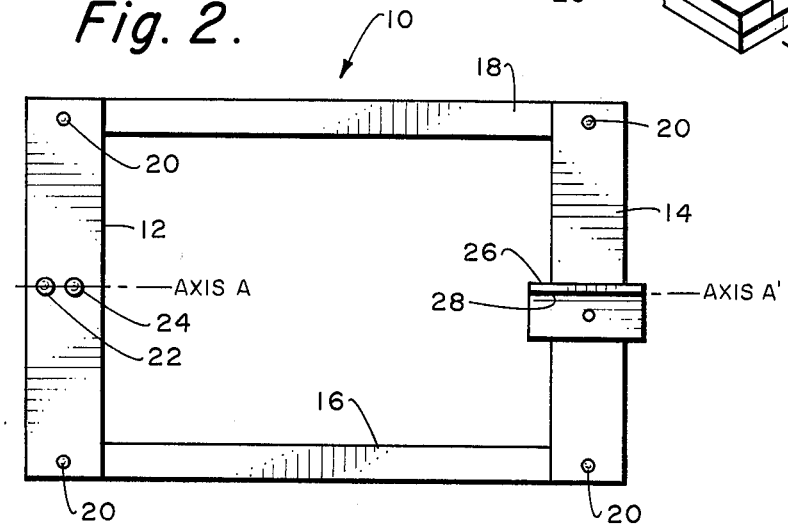
FIG. 2 is a bottom view of the apparatus of this invention taken along line 2—2 of FIG. 1.
Figure 3:
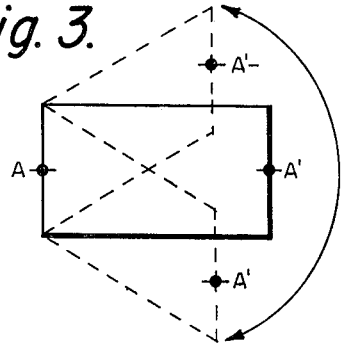
FIG. 3 is a schematic view showing the adjustability of the jig apparatus of this invention.
Figure 4:
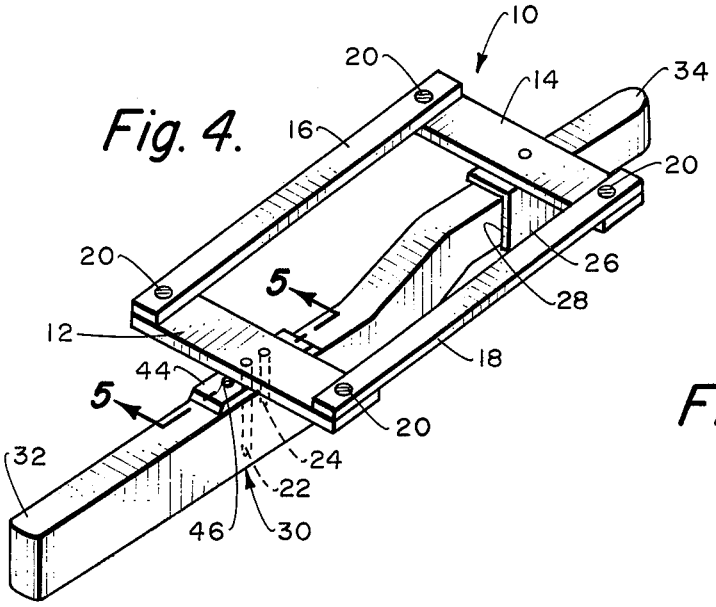
FIG. 4 is an isometric view of the jig apparatus of this invention showing how such is employed to locate a key button upon a piano key.
Figure 5:
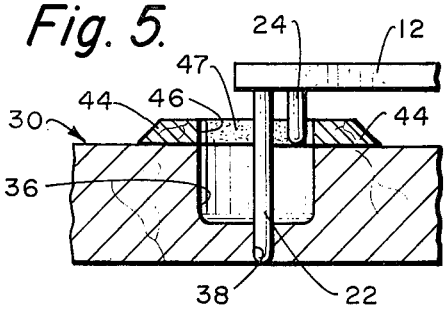
FIG. 5 is a cross-sectional view taken along line 5—5 of FIG. 4.
Figure 6:
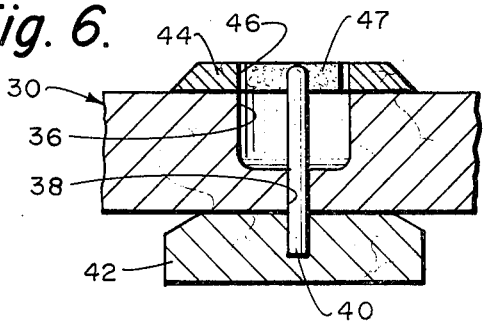
FIG. 6 is a view similar to FIG. 5 but showing the jig having been removed and the piano key being mounted upon its rail pin upon which such pivots during operation of the key.

Referring particularly to the drawing, there is shown the jig 10 of this invention which is composed of a pair of shortened side members 12 and 14 and a pair of elongated side members 16 and 18. Each of the shortened members 12 and 14 are basically identical in configuration and in length and comprise flat metal plate-like members. Also, each of the elongated members 16 and 18 are identical in configuration. The members 12, 14, 16 and 18 are interconnected together by bolts 20. The bolts 20 permit pivoting of the members with respect to each other and this pivoting movement is in the form of a parallelogram as shown in FIG. 3 of the drawing. In this parallelogram movement members 12 and 14 are always maintained parallel to each other with members 16 and 18 always remaining parallel to each other.

Attached to the underside of the member 12 is a pair of pins 22 and 24. Both pins 22 and 24 are basically cylindrical in configuration. A line interconnecting the centers of the pins 22 and 24 will be perpendicular to the longitudinal center axis of the member 12. This longitudinal center axis of member 12 is defined as a line interconnecting the pivot point established by the bolts 20 which are attached to the member 12. It is to be noted that the pin 22 is longer than the pin 24 and this will be explained further on in the specification.

Attached to the underside of the member 14 is an attaching plate 26 which is in the form of a right angle member. This attaching plate 26 has a planar surface 28. This planar surface is located perpendicular to the longitudinal center axis of the member 14. This longitudinal center axis of the member 14 is defined by a line interconnecting the pivot points of the bolts 20 which are connected to the member 14.

It is to be noted that the longitudinal placement of the plate 26 upon the member 14, as well as longitudinal placement of the pins 22 and 24 upon the member 12 is deemed to be a matter of choice, but it is normally preferable to have these members centrally located upon their respective member 12 or 14.

A typical piano key 30 is shown which has a striking end 32 and a finger pressing section 34. Intermediate the sections 32 and 34 is an enlarged opening 36 formed therein. A small sized rail pin receiving opening 38 connects with the opening 36 and extends outwardly of the bottom of the key 30. The outer end of the opening 36 connects with the top of the key 30.

During normal operation of the key 30, the opening 38 and the opening 36 cooperate with a rail pin 40. This rail pin 40 is attached to a rail 42 and upon the rail 42 there will be mounted a series of the rail pins 40. Each rail pin 40 is to cooperate with a separate key 30, with the keys 30 located in a very close side by side arrangement.

Placed upon the upper surface of the key 30 about the opening 36 is a key button 44. The key button 44 is constructed of wood or other similar rigid material and includes a felt bushing 47 comprising two separate sections mounted on each side of an elongated slot 46 formed within button 44. The purpose of the elongated slot 46 and felt bushing 47 is to provide adequate movement for the rail pin 40 as the key 30 is being moved. The felt-bushed sides of the slot 46 are to function to provide a guide for the movement of the key 30 so as to keep the key 30 from contacting adjacent keys. This means that the key button 44 must be very accurately positioned upon the key 30. This accurate positioning is achieved by means of the apparatus 10 of this invention.

The key button 44 is positioned in its approximate location on the key 30. The operator then places the long pin 22 and the short pin 24 within the openings 36 and 46 so that the long pin 22 cooperates within the opening 38. The member 12 then rests on the top of the key button 44. The operator then moves the plate 26 until it comes up against, or lies in line with the side wall of the fingertip pressing section 34. The operator then pushes the plate 26 so that it is flush against or parallel to the side wall of the fingertip section 34. Since the side wall of the fingertip section 34 is parallel to the longitudinal center axis of the fingertip section 34, this means that the surface of the plate 26 is also parallel to the longitudinal center axis of the fingertip section 34. Because of the parallelogram arrangement of the members 12, 14,16 and 18, this also means that the line interconnecting the center points of the pins 22 and 24 is parallel to the longitudinal center axis of the fingertip section 34.

Because the pins 22 and 24 are the same width as the slot 46, this means that the key button 44 is positioned so that the longitudinal center axis of the slot 46 is also parallel to the longitudinal center axis of the section 34.

With the key button 44 now correctly positioned, the operator then applies glue to the underside of the key button and then firmly presses such against the key 30. The adhesive is given time to dry and the jig 10 of this invention is removed and the key 30 replaced within the piano. Other fastening methods than adhesive, such as small nails or brads may be used, or combinations of methods, such as nails and adhesives may be used. The choice of fastening is optional.

When the key 30 is struck, the movement of the key 30 will be in a near perfect vertical plane so that the key 30 will not interfere with the adjacent keys and so that its motion will be free and its "touch" or feel will be correct.

What is claimed is:

1. A key button alignment tool for precisely locating a key button on a piano key, said key having a finger-tip contact end, a striking end, and an opening intermediate said ends, said fingertip end having a planar side wall which is parallel to the plane of movement of said key when struck;

a key button having a narrow longitudinal slot therein, said key button to be located upon said key over said opening with said slot to be parallel to said plane of movement;

said key button alignment tool comprising:

two pair of parallel members pivotally joined to form a parallelogram;

alignment means attached to one of said members, said alignment means being adapted to be placed within said slot and said opening; and abutment means attached to a second member parallel to said one member, said abutment means being adapted to be placed against said side wall;

whereby when said alignment means is placed within said slot and said opening and said abutment means is placed against said side wall, said slot will be parallel to said side wall.

2. The combination as defined in claim 1 wherein:

said abutment means comprises a flat plate member wherein the plane of said flat plate member is located exactly perpendicular to the longitudinal center axis of said second member, said plane of said flat plate member to be located flush against said side wall of said fingertip section.

3. The combination as defined in claim 1 wherein:

said alignment means comprises a pair of elongated pins located in an adjacent but spaced apart manner upon said one member, a line interconnecting the centers of said pins being perpendicular to the longitudinal center axis of said one member.

4. The combination as defined in claim 3 wherein:

one of said pins being of greater length than the other of said pins with said longer pin being adapted to be snuggly positioned within a small sized pin receiving opening located within said piano key, said pin receiving opening connecting with said opening formed within said piano key.

5. The combination as defined in claim 4 wherein:

said abutment means comprises a flat plate member wherein the plane of said flat plate member is located exactly perpendicular to the longitudinal center axis of said one member, said plane of said flat plate member to be located flush against said side wall of said fingertip end.

* * * * *